United States Patent [19]

Wing et al.

[11] Patent Number: 4,708,451

[45] Date of Patent: Nov. 24, 1987

[54] CONTAINER FOR DEVELOPING MACHINE

[75] Inventors: Ray D. Wing, Lake Oswego; Marine D. Lynch, Beaverton; John A. Rawitzer, Gladstone; Mark D. Whitney, Aloha, all of Oreg.

[73] Assignee: Wing-Lynch, Inc., Beaverton, Oreg.

[21] Appl. No.: 826,195

[22] Filed: Feb. 5, 1986

[51] Int. Cl.[4] ..... G03D 3/06

[52] U.S. Cl. ..... 354/312; 354/323; 354/330

[58] Field of Search ..... 354/310, 312, 313, 314, 354/316, 323, 329, 330, 307, 324; 206/315.11

[56] References Cited

U.S. PATENT DOCUMENTS

| | | | |
|---|---|---|---|
| 1,501,904 | 7/1924 | Harris | 354/307 |
| 2,783,875 | 3/1957 | Shabarick | 206/315.11 |
| 3,677,163 | 7/1972 | Porter | 354/307 |
| 3,695,162 | 10/1972 | Wing . | |
| 3,703,860 | 11/1972 | Wilkinson | 354/329 |
| 3,705,544 | 12/1972 | Ratowsky | 354/329 |
| 3,727,535 | 4/1973 | Streeter | 354/329 |
| 3,792,651 | 2/1974 | Banks | 354/330 |
| 4,169,671 | 10/1979 | Culler | 354/312 |
| 4,269,501 | 5/1981 | Griffith et al. | 354/323 |
| 4,277,159 | 7/1981 | Descotes | 354/330 |
| 4,586,805 | 5/1986 | Bockemuhl-Simon | 354/323 |

FOREIGN PATENT DOCUMENTS

| | | | |
|---|---|---|---|
| 1494737 | 12/1977 | United Kingdom | 354/329 |

OTHER PUBLICATIONS

Foley and Hegerty, "Automatic Processors", *Photomethods,* Mar., 1981.

"Introduction to Computerized Photographic Processing", Section I, pp. 1-1-1-6, 3-5-3-8.

"System 2500 Tanks", pp. 1-2, 13-20.

*Primary Examiner*—A. A. Mathews

*Attorney, Agent, or Firm*—Kolisch, Hartwell & Dickinson

[57] ABSTRACT

An apparatus for developing photosensitive material is provided. The apparatus includes a trough for holding fluid and a hollow container for holding film to be processed having a closed condition with the interior closed to light and an open condition with the interior open to fluid flow. A mount for positioning the container within the trough is also included, along with a control which selectively provides fluid flow within the trough and through the container when the container is open to such fluid flow.

12 Claims, 6 Drawing Figures

CONTAINER FOR DEVELOPING MACHINE

BACKGROUND OF THE INVENTION

This invention relates to a machine for developing photosensitive materials, and more particularly to a container for holding the materials to be processed, which container has a closed condition where the interior is closed off and an open condition where the interior is open.

In the film processing industry, there are a number of machines which are used to develop photosensitive materials. One such machine is illustrated in U.S. Pat. No. 3,695,162 issued Oct. 3, 1972, for DEVELOPING MACHINE FOR PHOTOGRAPHIC FILM, the disclosure of which is hereby incorporated by reference. The developing machine disclosed in the above-referenced patent includes a developing trough and a valve-controlled fluid supply system for sequentially furnishing developing, washing and setting solutions to the trough from dispensing containers. A programmable timer is provided to control the valves of the supply system and to establish the proper time sequence of the steps in a desired developing cycle. As discussed in the prior patent, a wire reel supports the film to be developed in a helical roll to expose uniformly the film to the developing solutions in the trough. The loaded film reel is placed inside a container which comprises a hollow, perforated cylinder. The cylinder is removably supported within the trough by circular hubs adapted to fit within the open ends of the cylinder, with one of the hubs attached to a motor mounted on the trough for rotating and agitating the cylinder.

The automatic developing machine disclosed in the prior patent constituted a significant improvement over the prior art due to its compactness, which made it suitable for use in a small space by a studio or photographer. With the advent of such compact automatic developing machines, there has been a concomitant significant rise in popularity of the small, one-person, fast processing turn-around developing shops. In such shops, it is highly desirable to have one person perform both functions of serving customers and operating the film processor. One of the disadvantages of most small developing machines presently used, is the fact that the initial steps of loading the film into the wire reel, placing the reel into the cylindrical sleeve, and mounting the sleeve within the trough have to be accomplished in a darkened environment. This necessitates that the film processing machine be located in a separate room from the lighted customer area. The few automatic film developing machines which do not have to be kept in a separate, darkened room are generally very expensive and large, making them unsuitable for small, one-person operations.

One prior art system uses a tube with a single end cap. A trough is not utilized in this system. Rather, fluid is injected directly into the tube. This fluid is subsequently drained from the tube when the tube is opened. Two serious drawbacks with this system are (1) that there is inferior flow of fluid to the film, which diminishes the quality of the processing, and (2) that it requires a complex tilting operation to entirely drain the fluid from the tube.

It is thus an object of the present invention to provide a film developing machine which overcomes the drawbacks and limitations in the prior art proposals. More specifically, the invention has as its objects the following: (1) to provide a film developer which will eliminate the need to locate the developing machine in a separate, dark room remote from the customer area; (2) the provision of an inexpensive developing machine which can be used in a small, one-person, quick turnaround, photo developing operation; (3) to provide a means for retrofitting existing machines for use outside of dark rooms; (4) the provision of a developing machine having a container for supporting the film, where the interior of the container is closed off to light in one condition and in another condition where the interior is open for receiving developing fluid; (5) to provide a container having ends which are fluid pervious, but light impervious; (6) to provide a film developing system which utilizes a trough to provide the most complete and random flow of fluid to maximize the quality of the processing; and (7) to accomplish the above objects with a machine that is relatively inexpensive and which may be operated by one who has received limited training.

SUMMARY OF THE INVENTION

One way by which these and other objects may be attained is by providing apparatus for developing photosensitive materials, of the type having a trough for holding fluid. Disposed in the trough is a hollow container for holding the materials to be processed, which container has a closed condition where the interior is closed to light and an open condition where the interior is open to fluid flow. The apparatus further includes means for mounting the container within the trough, means adjustable with the container for opening up the container, and means for selectively providing fluid flow within the trough and through the container when the container is open.

Another aspect of the invention may be defined as a container for holding film which is selectively opened to fluid flow to facilitate processing of the film. Such a container would include a first member having at least one opening therein, and a second member having a configuration complementary to the configuration of the first member, with the second member being slidably mounted to the first member and including closure means for selectively sliding over and closing the opening in the first member. The first member is normally cylindrical in this aspect of the invention.

These and other objects, features and advantages of the present invention will become more fully apparent when the following detailed description of a preferred embodiment is read in connection with the accompanying drawings.

DETAILED DESCRIPTION OF A PREFERRED EMBODIMENT

Figure 1:
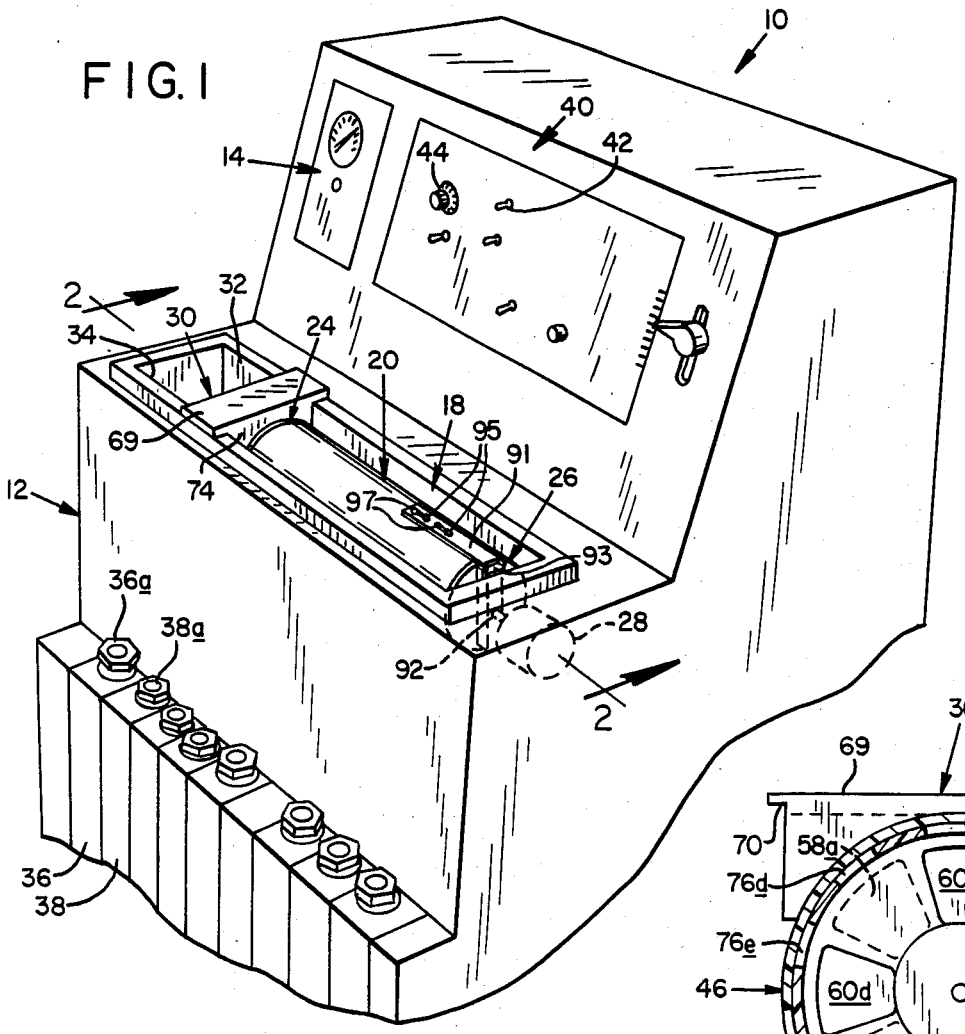
FIG. 1 is a fragmentary perspective view of a film developing apparatus which employs a container constructed according to the present invention.

Referring now to the drawings, and more particularly to FIG. 1, there is shown generally at 10 a film developing apparatus which includes a cabinet 12 and a control console 14. Cabinet 12 acts as a base for a developing trough 18. Trough 18 includes a removable cover which has been deleted from the figures to permit illustration of the interior of the trough. Also included but not depicted is a dam which defines the operating portion of trough 18. This dam is described in detail in the prior patent.

Disposed in trough 18 is a container shown generally at 20 for holding the film or other photosensitive material to be processed. The container is mounted within trough 18 by a first end cover assembly 24 which closes off one end of the container, and a second end cover assembly 26 which closes off the other end of the container and connects the container to a drive motor 28 which is mounted adjacent trough 18. First end cover assembly 24 includes a bridge 30 which spans and rests on the sides 32 and 34 of trough 18.

Mounted on cabinet 12 are a plurality of fluid dispensing containers, such as illustrated at 36 and 38, with intake caps 36*a* and 38*a*, respectively, designed to contain the various developing solutions used in the apparatus. A fluid supply network (not shown), carries the developing solution from dispensing containers 36 and 38 to trough 18.

Control console 14 surrounds a programmable timer (not shown) and includes a front control panel 40 which has various switches 42 and dials 44 thereon. The control panel can be set by the operator to automatically regulate the fluid supply system in the film developing apparatus 10. A detailed description of the fluid supply system and the automatic control system is set forth in the previously referenced U.S. Pat. No. 3,695,162.

Figure 4:
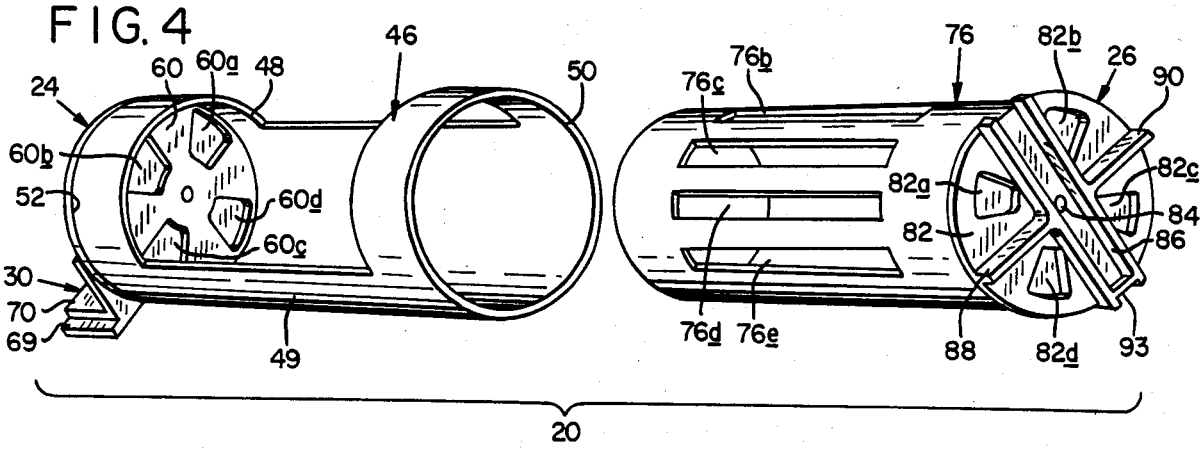
FIG. 4 is a perspective view of the container depicted in FIGS. 1 through 3.
Figure 6:
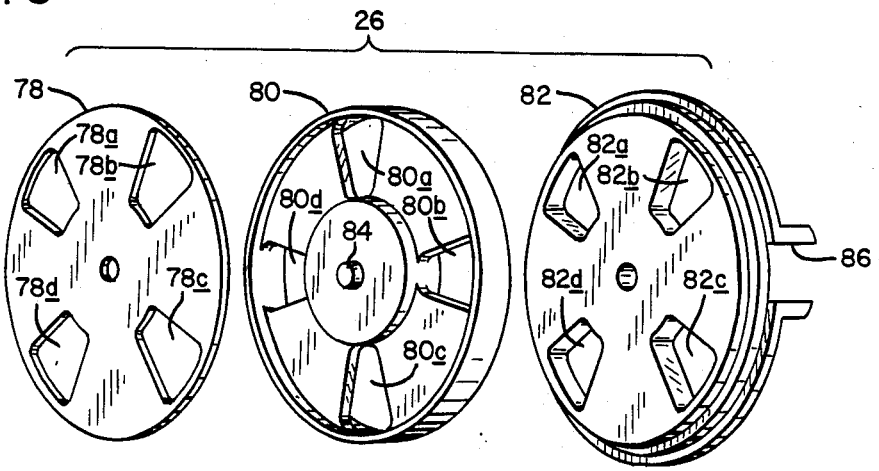
FIG. 6 is an exploded view of a second end cover assembly for the container of the depicted embodiment, which includes means for mounting the container to a drive motor.

Container 20, best shown in FIG. 4, includes a hollow, elongate, cylindrical outer member 46 having a perforation or elongate slot 48 extending axially along the side thereof, and a closure means or solid portion 49 comprising most of the rest of the side wall of outer member 46. Outer member 46 has an open end 50, and an end 52 which is connected to first end cover assembly 24. First end cover assembly 24 mounts and closes off end 52 of container 20.

Figure 2:
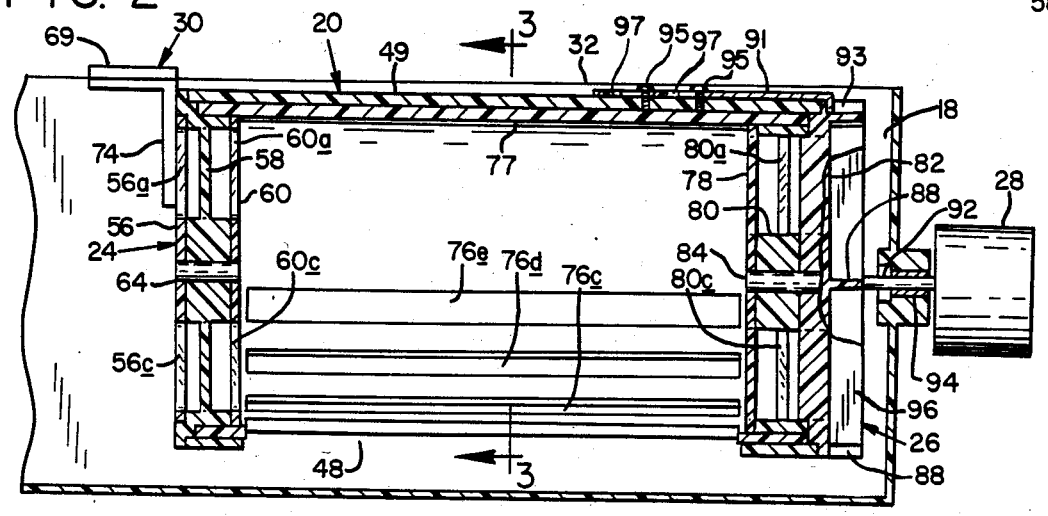
FIG. 2 is a fragmentary cross sectional view taken generally along line 2—2 in FIG. 1, showing the container disposed in the trough.
Figure 5:
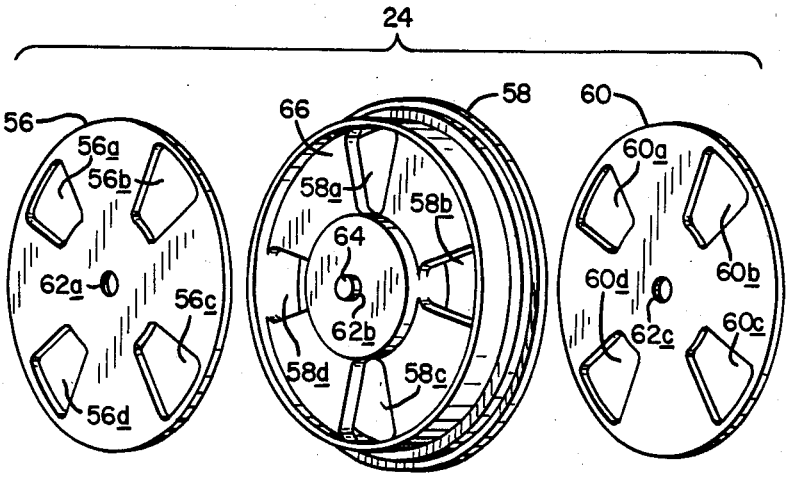
FIG. 5 is an exploded view of a first end cover assembly for the container of the depicted embodiment.

The three-leaf construction of first end cover assembly 24 is best shown in FIG. 5. It includes a first leaf 56 having apertures 56*a*–56*d;* a larger, sandwiching leaf 58 having apertures 58*a*–58*d;* and a third leaf 60 having apertures 60*a*–60*d*. Each of leaves 56, 58 and 60 contain a entral bore 62*a*, 62*b*, 62*c*, respectively, through which an alignment pin 64 is passed. Leaves 56, 58 and 60 are normally glued together, although other fastening means may alternatively be used. In an assembled condition, first leaf 56 and third leaf, 60 overlay sides 66 and 68, respectively, of sandwiched leaf 58. The solid portions of leaves 56 and 60 overlay aperture 58*a*–58*d* and act as a shutter, closing off the container to light. As shown in FIG. 2, the spacing of leaves 56, 58 and 60 is such, however, that developing fluid from the trough is allowed to pass between the leaves and into or out of the interior of container 20. This assembly also assists in venting container 20 to further assist in fluid flow. It should be appreciated that while this is the preferred construction of assembly 24, it is possible in alternate embodiments that the assembly simply comprise a cap which is closed to fluid flow.

Figure 3:
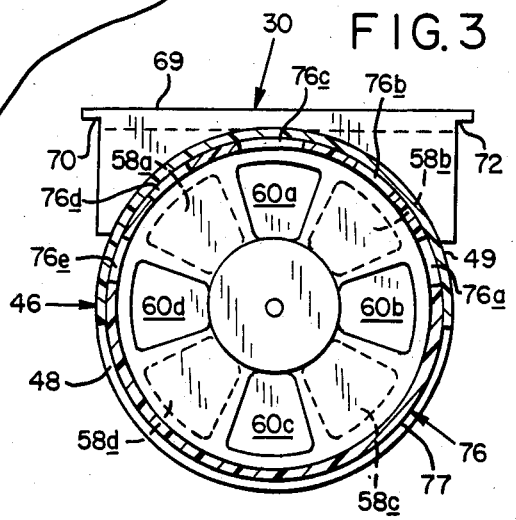
FIG. 3 is cross sectional view taken along line 3—3 in FIG. 2.

As best seen in FIG. 3, bridge 30 includes a substantially rectangular bar 69 which spans the sides 32, 34 of trough 18. A pair of arms 70, 72 are disposed adjacent the ends of bar 69, and act as stops to retain the bar between the sides of the trough. Bar 69 is joined to a plate 74, as best shown in FIGS. 1 and 3, forming an L-shaped arrangement therewith (see FIGS. 1 and 3). Plate 74 is fixed to first end cover assembly 24 so that bridge 30 acts to nonrotatably mount outer member 46 to apparatus 10. So constructed, bridge 30 can be positioned at various locations along the length of trough 18 in order to accommodate containers of different lengths. Plate 74 is backed up by the dam (not shown) which prevents fluid flow beyond the plate except when fluid flows over the dam.

Container 20 further includes an elongate, hollow cylindrical inner member 76 (see FIG. 4) having a plurality of elongate slots 76*a*–76*e* extending axially along the sides thereof, and a solid portion 77 (see FIG. 3) covering the remaining side surface area thereof. Inner member 76 is designed to fit snugly in coaxial arrangement within outer member 46. Second end cover assembly 26 is disposed on one end of inner member 76. Second end cover assembly 26, like first end cover assembly 24, is of three-leaf construction and includes a first leaf 78 with apertures 78*a*–78*d;* a dish-like center leaf section 80 having apertures 80*a*–80*d;* and a third leaf which is in the form of an outer hub 82 having apertures 82*a*–82*d*. Leaf sections 78, 80 and 82 are aligned with an alignment pin 84 and are typically glued together. An elongate U-shaped channel 86 is disposed transversely of outer hub 82 and extends outwardly therefrom. Webs 88 and 90 are joined to the outer sides of channel 86.

The sections of second end cover assembly 26, similar to those of first end cover assembly 24, are aligned so that the solid portions of the center leaf section 80 cover the apertures of outer hub 82 and first leaf 78 so that the assembly is fluid pervious, but light impervious. That is, the spacing of the three leaves of assembly 26 is such that fluid is permitted to pass around and between the leaves but light will not be able to pass through (see FIG. 2). This feature maximizes fluid flow within container 20 by assisting in the venting and further increasing the cross-sectional area of the open part of the container. As with first end cover assembly, this specific construction is not an essential aspect of the invention, because it will still function as intended if caps are used which are fluid impervious.

As best illustrated in FIG. 2, an output shaft 92 extends outwardly from drive motor 28 and through a bushing 94 in the side of trough 18. Connected to the end of output shaft 92 is a drive bar 96 which is received in U-shaped channel 86 of second end cover assembly 26 and detachably connects this assembly and inner member 76, to motor 28.

Outer and inner members 46 and 76 are relatively rotatable and, in an operative condition, form a shell in the container with the film to be processed disposed within the inner member. Relative rotation of inner member 76 serves to move perforations or elongate slots 76*a*–76*e* in and out of registration with perforation 48 of outer member 46 so as to open up and close off the interior of the container to fluid.

Operation of the Depicted Embodiment

In a typical cycle of operation, the operator loads photosensitive material such as photographic film onto a wire reel (not shown), which is then inserted through one end of container 20. First and second end cover assemblies 24 and 26 are mounted on the ends of container 20, and second end cover assembly 26 is manually turned so as to rotate inner member 76 to a closed condition where the interior of the container is closed off to light; that is, with slots 76*a*–76*e* aligned with solid portion 49 of outer member 46. This loading of the film onto a reel must be accomplished in a darkened environment such as in a hooded apparatus or changing bag (not shown) of the type having hand-holes. This is the only part of the operation which requires a darkened environment. Therefore, an entire dark room is not required. In fact, the dark hood may be situated directly adjacent the customer counter, so that the same person can be servicing customers and processing the film.

After the film is loaded and the interior of the container is closed off to light, it is no longer necessary to maintain the container in a darkened environment. The operator may at this point transfer the loaded container 20 to trough 18 in the film developing apparatus 10. But before doing so, a clip 91 is normally positioned on the container to prevent inadvertent relative rotation between outer and inner cylinders 46 and 76. When clip 91 is in this engaged position, the clip engages a groove 93 in second end cover assembly 26, which, of course, is mounted to inner cylinder 76. Clip 91 also includes a pair of slots 97 for engagement of a pair of bolt heads 95 which extend from outer cylinder 46. Thus, in this engaged condition, relative rotation between outer and inner cylinders 46 and 76 is prevented.

Clip 91 is disengaged and removed when the loaded container 20 is placed in trough 18 and engaged into the drive motor. To do this, channel 86 of second end cover assembly 26 is slid over drive bar 96, and the other end of container 20 is dropped into trough 18 until arms 70 and 72 of bridge 30 rest on the sides 32 and 34 of the trough. A cover (not shown) is then placed over trough 18 to prevent light from entering the developing trough while the film is being processed.

Once motor 28 is activated, inner member 76 will be slowly rotated to bring elongate slots 76*a*–76*e* into rotational alignment with slot 48, thus opening the interior of container 20 to fluid flow. The appropriate controls of apparatus 10 then begin pumping developing fluid into the end of trough 18 which is adjacent motor 28. The fluid can flow through slots 76*a*–76*e* and into the container to develop the film held therein. If a fluid permeable second end cover assembly 26 is included, fluid will also flow into the container through such assembly. As inner cylinder 76 continues to rotate, the fluid is slowly agitated within the container to maximize the efficiency of the developing process. The reels (not shown) on which the film is spooled are also slowly rotationally "walking" during rotation of inner member 76 so that even if the level of fluid within container 20 does not quite reach the height of the center of the reels, all of the film on such reels will be subjected to fluid flow. As the open end of slot 86 is facing upwardly, that end of container 20 may drop down slightly until it contacts the bottom of trough 18 but the resulting rocking motion assists in the agitation of fluid within the container.

This agitation process continues and fluid randomly flows through trough 18 and in and out of container 20 via slots 48 and 76*a*–76*e* to thoroughly process the film contained therein. This film processing procedure is described in more detail in the prior patent cited above.

When film processing is completed, motor 28 will be stopped in a position such which causes slots 76*a*–76*e* to be covered by the solid portion 49 of outer member 46. The trough cover can then be removed and container 20 is lifted from trough 18. The developed film can subsequently be removed and dried and suitably mounted for delivery to the customer.

Thus, it is apparent from the construction described that a film developing operation may be accomplished by a person responsible for both processing the film as well as waiting on customers. It is also apparent that the film container can be easily placed in and removed from the developing trough.

One aspect of the invention which might be changed concerns the relative rotation of the outer and inner cylinders. In the depicted embodiment, only the inner cylinder rotates. It may be possible, in an alternate embodiment, that both of the cylinders rotate together during at least a portion of each cycle. This and other modiiications are within the spirit and scope of the invention.

It is claimed and desired to be secured by Letters Patent:

1. In an apparatus for developing photosensitive material;

a trough for holding fluid;

removable cover means for closing off said trough to light;

a hollow container for holding material to be processed having a closed condition where the interior is closed to fluid flow and an open condition where the interior is open to fluid flow;

means for mounting the container within the trough;

means for changing the condition of said container from the closed to open and open to closed conditions; and means for selectively providing fluid flow within said trough and through said container when said container is in an open condition.

2. The apparatus of claim 1 wherein said container includes a first member having at least one opening therein, and a second member having a configuration complementary to the configuration of said first member, said second member being slidably mounted to said first member and including closure means thereon for selectively sliding over and closing said opening in said first member to thereby change the condition of said container between the closed and open conditions.

3. The apparatus of claim 1, wherein said container is generally cylindrical.

4. In an apparatus for developing photosensitive material which includes a fluid-retaining developing trough and a motor with an output shaft mounted adjacent the trough, a container disposed in the trough for supporting therewithin material to be processed, said container comprising:

inner and outer relatively rotatable, hollow cylindrical, coaxial members forming a shell in the container disposed with said inner member fitting within said outer member, said members having perforated sides and the perforations of the sides moving in and out of registration with relative rotation of said members;

means nonrotatably mounting one of said members in the trough; and means securing the other of said members to the output shaft of the motor for rotation therewith.

5. The apparatus of claim 4, wherein the trough has sides and said means nonrotatably mounting one of said members spans the sides of the trough and rests on the sides.

6. The apparatus as claimed in claim 5, wherein the motor securing means is detachable.

7. A container for use in an apparatus for developing photosensitive material and having a drive motor, comprising:

an elongate cylindrical outer member defining a perforation in a side thereof;

an elongate cylindrical inner member snugly fitted in said outer member and defining a perforation in a side thereof, said inner member being relatively rotatable within said outer member, relative rotation of said members serving to move said perforations in and out of registration to open and close the interior of said container;

a first end cover assembly mounted to one end of said outer member, and means secured to said first end cover assembly for nonrotatably mounting said outer member to said apparatus; and a second end cover assembly mounted to one end of said inner member, and means connected to said second end cover assembly for detachably mounting said inner member to the drive motor.

8. The container of claim 7, wherein said one end of said inner member is opposite from said one end of said outer member.

9. The container of claim 7, wherein at least one of said end cover assemblies is fluid pervious, but light impervious in at least one of the relative rotational positions of said members.

10. The container of claim 7, wherein said perforations comprise elongate slots extending axially along said sides of said members.

11. The container of claim 10, wherein said slot in said outer member is disposed in a lower portion of said outer member when said outer member is nonrotatably mounted.

12. The container of claim 11, wherein said slot in said outer member covers at least about one-third of the circumferential periphery of said outer member, and wherein said inner member includes a plurality of axial slots extending over a portion of the circumferential periphery of said inner member which corresponds to the circumferential extension of said outer member slot.

* * * * *